US005645402A

United States Patent [19]

Cornelius et al.

[11] Patent Number: 5,645,402

[45] Date of Patent: Jul. 8, 1997

[54] TURBINE BLADE VIBRATION DAMPENING

[75] Inventors: Charles C. Cornelius; Gregory P. Pytanowski; Jonathan S. Vendituoli, all of San Diego, Calif.

[73] Assignee: Solar Turbines Incorporated, San Diego, Calif.

[21] Appl. No.: 631,313

[22] Filed: Apr. 10, 1996

[51] Int. Cl.[6] ..... F01D 5/22

[52] U.S. Cl. ..... 416/190; 416/191

[58] Field of Search ..... 416/190, 191, 416/194, 195

[56] References Cited

U.S. PATENT DOCUMENTS

| | | | |
|---|---|---|---|
| 2,315,642 | 4/1943 | Mosser | 416/191 |
| 3,377,050 | 4/1968 | Guy | 416/191 |
| 4,767,273 | 8/1988 | Partington | 416/190 |
| 4,840,539 | 6/1989 | Bourcier et al. | 416/195 |

FOREIGN PATENT DOCUMENTS

| | | | |
|---|---|---|---|
| 873151 | 6/1971 | Canada | 416/190 |
| 693041 | 11/1979 | U.S.S.R. | 416/190 |

*Primary Examiner*—Edward K. Look
*Assistant Examiner*—Mark Sgantzos
*Attorney, Agent, or Firm*—Larry G. Cain

[57] ABSTRACT

The present turbine wheel assembly increases component life and turbine engine longevity. The combination of the strap and the opening combined with the preestablished area of the outer surface of the opening and the preestablished area of the outer circumferential surface of the strap and the friction between the strap and the opening increases the life and longevity of the turbine wheel assembly. Furthermore, the mass "M" or combined mass "CM" of the strap or straps and the centrifugal force assist in controlling vibrations and damping characteristics.

19 Claims, 5 Drawing Sheets

TURBINE BLADE VIBRATION DAMPENING

"The Government of the United States of America has rights in this invention pursuant to Contract No. DE-AC02-87CE40812 awarded by the U.S. Department of Energy."

TECHNICAL FIELD

This invention relates generally to a gas turbine engine turbine disk and blade assembly and more particularly to the turbine blade tip configuration used to control blade vibration.

BACKGROUND ART

Turbine blades used in high performance gas turbine engines are subject to time varying aerodynamic forces that cause the blades to vibrate and potentially fail due to material fatigue. To increase reliability and cycle life of individual components, such as blades, within the engine high strength materials have been used. Additionally, attempts have been made to avoid coincidence of turbine blade natural frequencies and the frequencies associated with unsteady aerodynamic forces. Furthermore, attempts have been made to reduce the effectiveness of the aerodynamic forces that cause blade vibrations. And, attempts have been made to increase the damping which controls the blade vibration magnitude.

The present invention is directed to overcome one or more of the problems as set forth above.

DISCLOSURE OF THE INVENTION

In one aspect of the present invention, a turbine blade is comprised of a root portion, a base portion extending radially from the root portion, a blade portion extending radially form the base portion and having a reaction side defined thereon and a tip portion. The tip portion has an inner surface attached to the blade portion and an outer surface spaced from the inner surface. A bridge member is attached to the outer surface and an opening having a preestablished cross-sectional configuration is defined between the outer surface and the bridge member.

In another aspect of the invention, a turbine wheel assembly is comprised of a disk and a plurality of blades. Each of the plurality of blades is mounted in the disk at a root portion. Each of the plurality of blades has a tip portion and the tip portion defines an outer surface, a bridge member attached to the outer surface and an opening having a preestablished cross-sectional configuration being defined between the outer surface and the bridge member. A strap is positioned in the opening of corresponding ones of the plurality of blades.

BEST MODE FOR CARRYING OUT THE INVENTION

Figure 1:
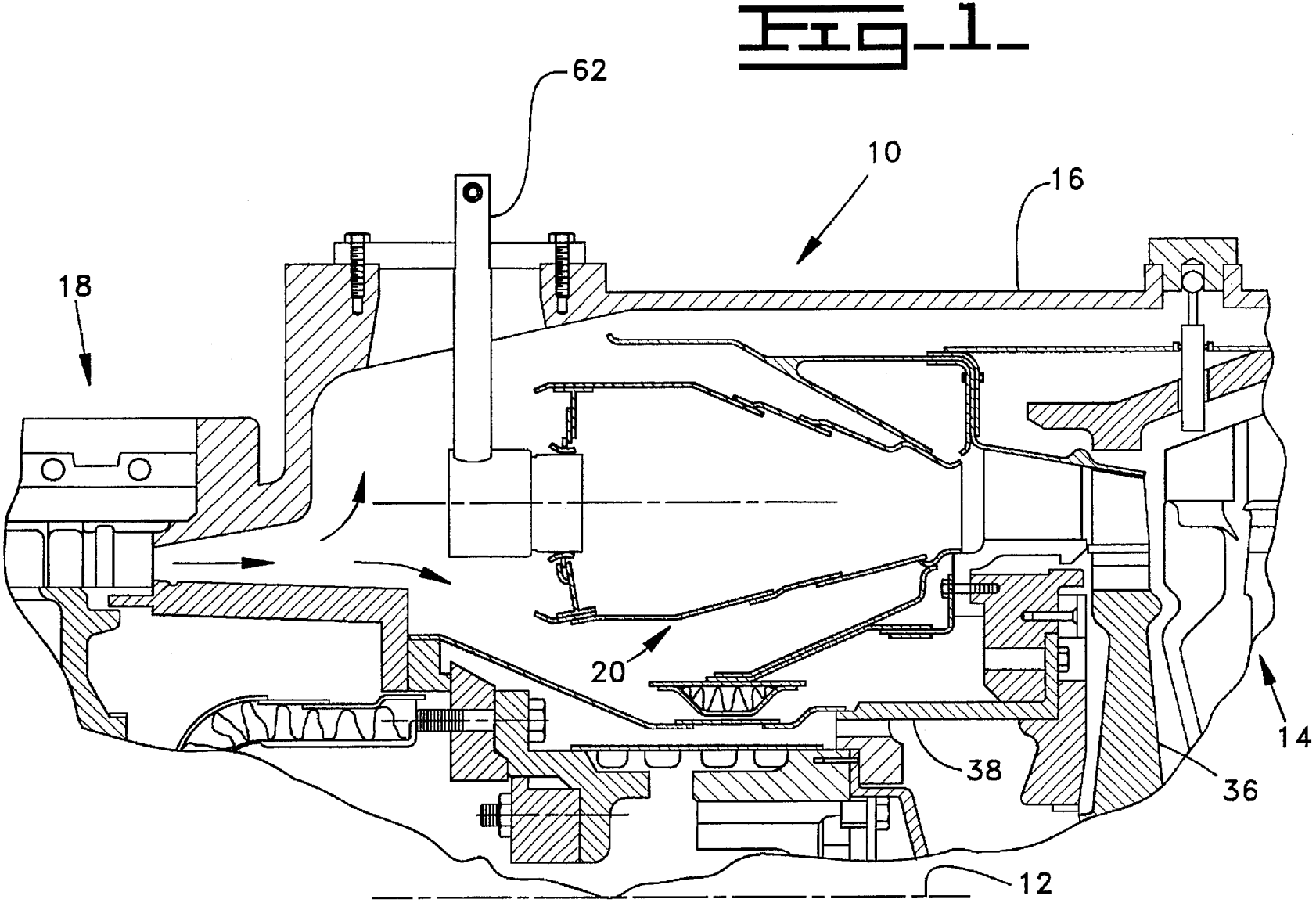
FIG. 1 is a partially sectioned view of a gas turbine engine embodying the present invention.
Figure 2:
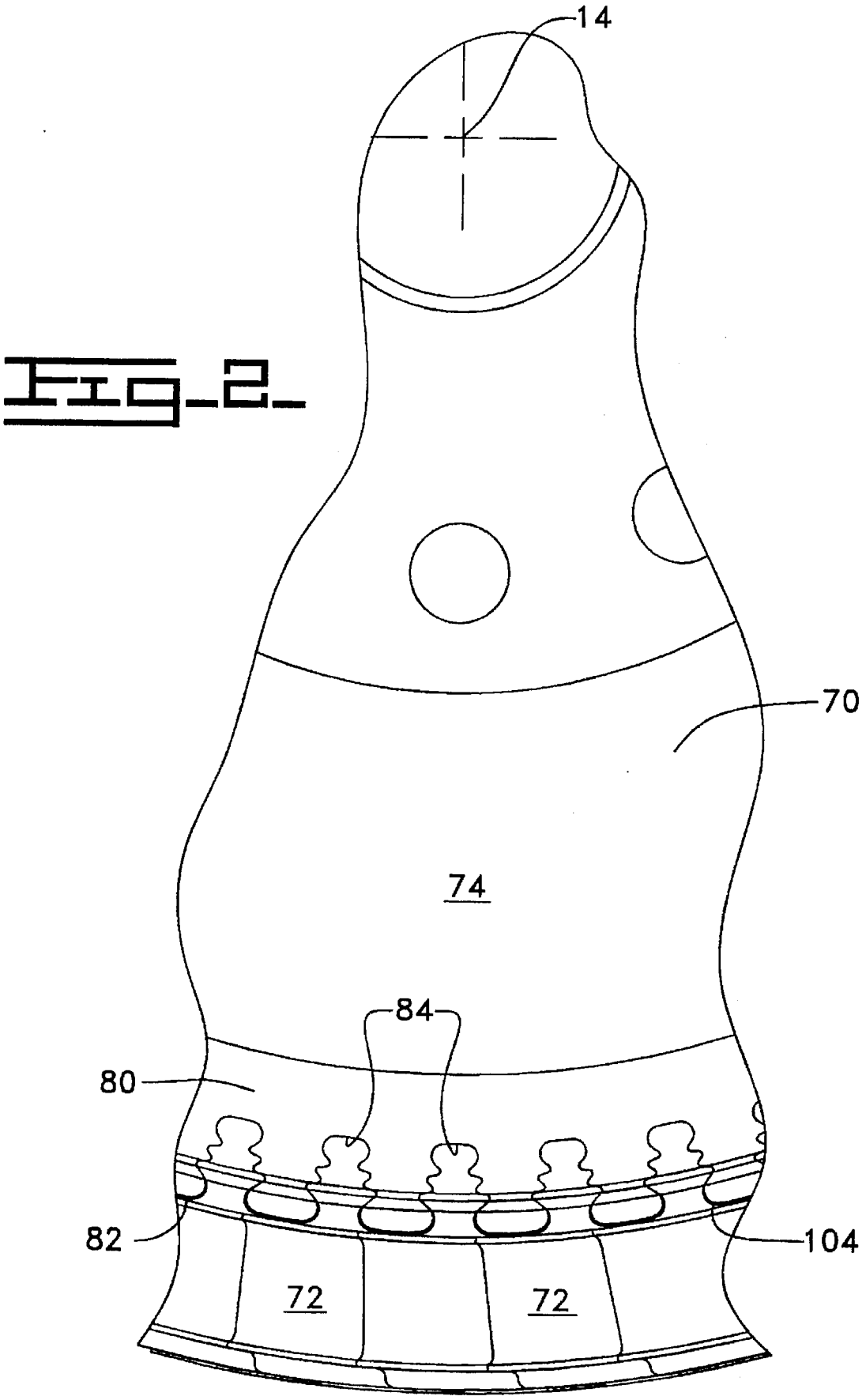
FIG. 2 is a sectional view of a portion of a turbine wheel assembly embodying the present invention.

Referring to FIGS. 1 and 2, a gas turbine engine 10, not shown in its entirety, having a central axis 12 has been sectioned to show a turbine section 14 of the engine. The engine 10 includes an outer case 16 in which is housed a compressor section 18 and a combustor section 20 being in fluid communication with the turbine section 14. The turbine section 14 includes a plurality of turbine stages 36 disposed within a turbine nozzle support assembly 38. The assembly 38 is supported from the outer case 16 in a conventional manner.

As best shown in FIG. 2, the turbine section 14 is of a generally conventional design. For example, each of the turbine stages 36 includes a turbine wheel assembly 70 disposed axially adjacent the nozzle and shroud assembly 38. The turbine wheel assembly 70 is generally of conventional design and has a plurality of turbine blades 72 mounted in a disk 74. Each of the turbine blades 72 are made of any conventional material; however, each of the plurality of blades could be made of a ceramic material without changing the essence of the invention.

In this application and best shown in FIG. 2, the disk 74 is made of a metallic material having a flange or an outer extremity 80 defining an outer perimeter 82. Around the outer perimeter 82 of the disk 74 are a plurality of slots 84 each of which receive a portion of the turbine blade 72. In this application, each of the plurality of slots 84 have a conventional fir tree configuration.

Figure 3:
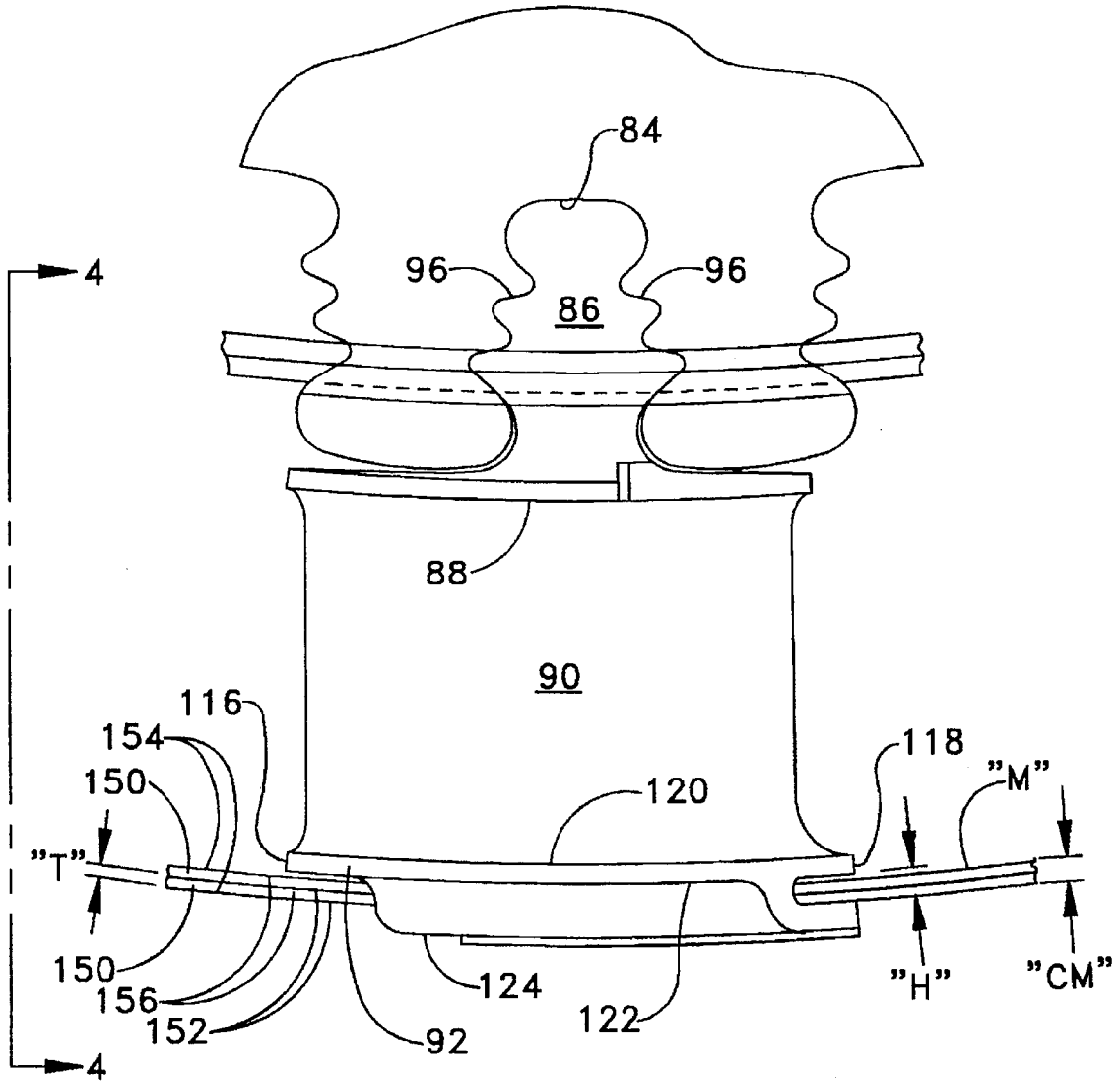
FIG. 3 is an enlarged view of a portion of the turbine wheel assembly of FIG. 2.
Figure 4:
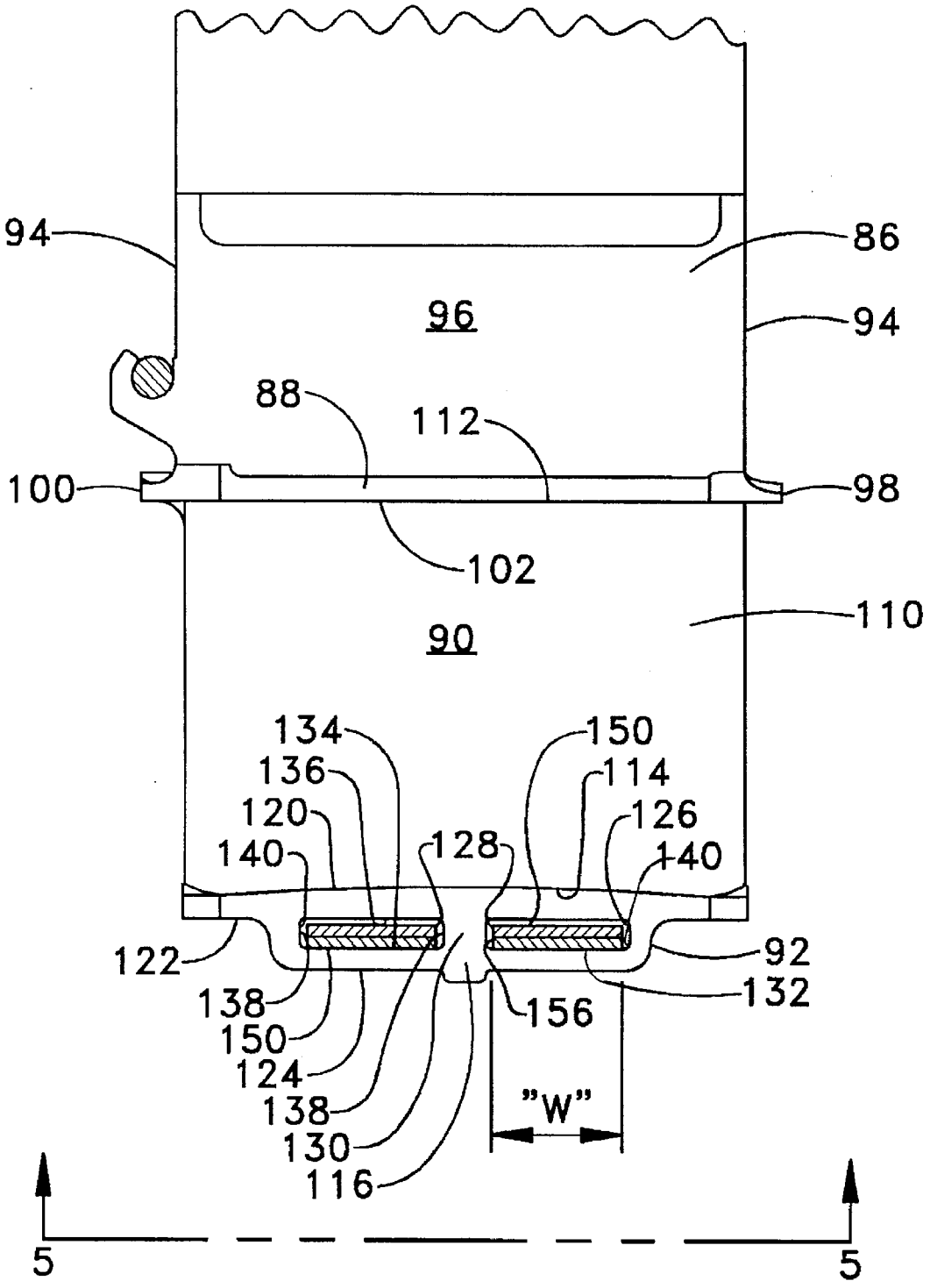
FIG. 4 is an enlarged sectional view of a portion of FIG. 3 taken along lines 4—4 of FIG. 3.
Figure 5:
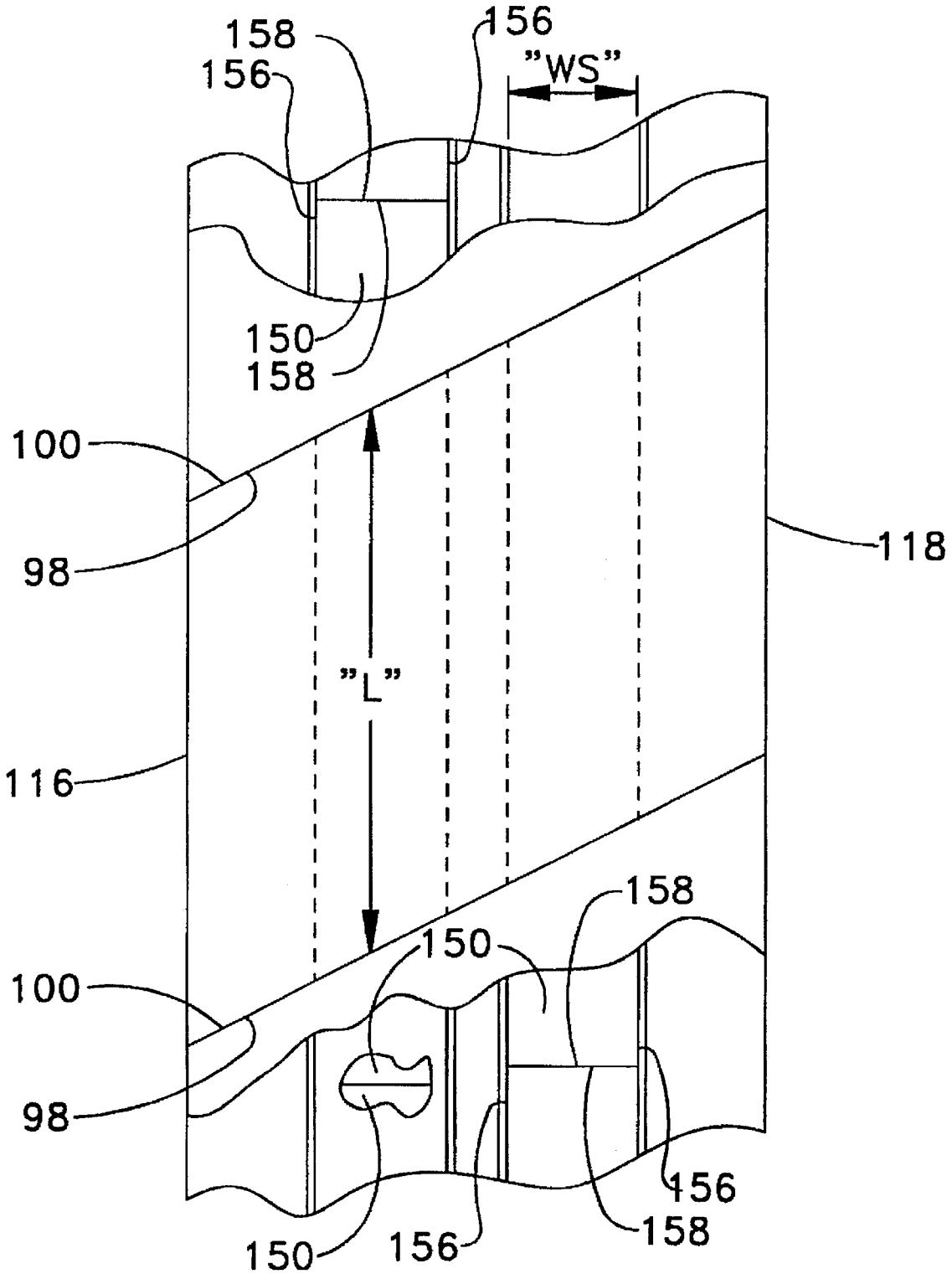
FIG. 5 is an elevational view of a portion of FIG. 4 taken along lines 5—5 of FIG 4.

In this application and best shown in FIGS. 3 and 4, each of the plurality of blades 72 are defined by a root portion 86 confined within a respective one of the plurality of slots 84. A base portion 88 extends radially from the root portion 86, a blade portion 90 extends radially from the base portion 88 and a tip portion 92 extends radially from the blade portion 90. The blade 72, in this application, is made of a metallic material. The root portion 86 includes a pair of end surfaces 94 and a pair of side surfaces 96 extending between the end surfaces The pair of side surfaces 96 form a generally fir tree configuration. The base portion 88 has a first side 98 and a second side 100 being generally parallel to the first side 98. The base portion 88 further defines a first surface 102 being spaced from the root portion 86 and defining a preestablished thickness. Corresponding ones of the first side 98 of the plurality of blades 72 are positioned in close generally sealing relationship with the second side 100 of corresponding ones of the plurality of blades 72 and form an inner circumferential ring 104. The blade portion 90 defines a reaction side 110 having a generally concave configuration, a first end portion 112 being adjacent the base portion 88 and a second end 114 being adjacent the tip portion 92. The tip portion 92 defines a generally parallelagram configuration having a first side 116 and a second side 118 being generally parallel to the first side 94. An inner surface 120 of the tip portion 92 is attached to the blade portion 90 and an outer surface 122 having a radiused configuration being centered about the axis 14 is spaced from the inner surface 120 and defines a thickness. Attached to the outer surface 122 is a bridge member 124 defining an opening 126. The opening 126 is tangential to the outer surface 122. In this application the opening 126 is divided into a pair of openings 128 by a strut 130. Thus, as best shown in FIG. 4, each of the pair of openings 128 define a generally elongated slot 132 having a preestablished rectangular cross-sectional configuration defining an outer surface 134, an inner surface 136 and a pair of sides 138 interconnecting the outer surface 134 and the inner surface 136. The slot 132 has a preestablished length extending substantially the length between the first side 98 and the second side 100, as designated by "L" as best shown in FIG. 5, a preestablished height, as designated by "H", and a preestablished width, as designated by "W". The slot 132 further includes a plurality of radiused corners 140.

As further shown in FIG. 5, positioned within the slot 132 formed in each of the plurality of blades 72 is a strap 150 having a generally rectangular cross-sectional configuration defining an outer circumferential surface 152, an inner circumferential surface 154 and a pair of sides 156 interconnecting the outer circumferential surface 152 and the inner circumferential surface 154. The strap 150 further includes a pair of ends 158 being abutted but not connected. The rectangular configuration further defines a thickness, designated by "T", and a width, designated by "WS" resulting in a preestablished mass, designated by "M". For example, the strap 150 makes a 360 degree rotation about the plurality of blades 72. In this application, an additional one of the straps 150 circles the inner strap 150 forming a two tier configuration. In this application, the ends 158 of the inner strap 150 and the outer strap 150 of the two tier configuration are offset. As an alternative however, the offsetting of the ends 158 is not a necessity. Thus, as shown in FIG. 3, a pair of straps 150 are defined by a preestablished thickness and width to create a preestablished combined mass, designated by "CM". The pair of straps generally surround the tip portion 92 of the plurality of blades 72 in the assembled position in the turbine wheel assembly 70.

INDUSTRIAL APPLICABILITY

In operation, the gas turbine engine 10 is started and the speed of the gas turbine engine 10 increases to an operating condition. As the speed of the gas turbine engine 10 is varied, the speed of the turbine wheel assembly 70 is also varied. The resulting change in speed varies the resulting centrifugal forces acting on the plurality of blades 72. The combination of the straps 150 positioned in the opening 126 in the plurality of blades 72 compensate for and controls blade vibration. In this application, due to the size of the individual blade 72 a pair of openings 128 are utilized and a pair of straps 150 are used in each of the pair of openings 128. For example in the assembled position in this application, the straps 150 are of a rectangular configuration and fully encapsulated by the bridge member 124. However, in other applications, a single strap 150, a single opening 132 and a bridge member 124 extending short of the first side 98 and/or second side 100 of the tip portion 92 could be used. Furthermore, any combination of the number, mass, or configuration, such as ellipse, triangular, trapezoidal, round, square or rectangular, of the straps 150, opening 126 and bridge member 124 length or width could be utilized without changing the essence of the invention.

During operation of the turbine wheel assembly 70 the centrifugal forces acting on the preestablished mass "M" of the straps 150 push the straps 150 outward and against the preestablished area formed by the combination of the length "L" and the width "W" of the slots 132 in each of the plurality of blades 72. Thus, the inner surface 136 of the opening 126 and the slot 132 is in contacting relationship with the outer circumferential surface 152 of the strap 150. The forced contact of the strap 150 against the preestablished area of the slot 132 in each of the plurality of blades 72 sets up a friction force between the two surfaces. Any motion between the straps 150 and the corresponding preestablished area of the slot 132 caused by vibration will create friction which will produce beneficial damping.

In the case where the frictional forces is sufficiently high the straps 150 will essentially tie the individual blades 72 into a continuous structure. The significance of the continuous structure is that it takes advantage of the phase relationship between the aerodynamic forces and the blade vibration. On any individual blade 72 of the plurality of blades 72 the magnitude of the aerodynamic force felt on the reaction side 110 and transferred to the blade 72 could be relatively high. However, over the continuous structure of the turbine wheel assembly 70 the phasing of the aerodynamic force results in a net force of near zero and hence minimum vibration. The combination of the damping and resulting continuous structure using the strap 150 and the tip portion 92 with the bridge member 124 having the pair of opening 128 therein functionally compensates for vibrations and varying magnitudes of the aerodynamic forces acting on individual blades 72 of the plurality of blades 72.

Thus, the primary advantages of the turbine wheel assembly 70 is to provide a dampening and vibration system to increase life and longevity of the turbine wheel assembly 70 and individual blades 72. The combination of the strap 150 and the slot 132 combined with the preestablished area by the length and width of the slot 132 and the friction between the strap 150 and the slot 132 increases the life and longevity of the wheel assembly 70. Furthermore, the mass "M" or combined mass "CM" of the strap 150 or straps 150 and the centrifugal force assist in controlling vibrations and damping characteristics.

Other aspects, objects and advantages of this invention can be obtained from a study of the drawings, the disclosure and the appended claims.

We claim:

1. A turbine wheel assembly comprising:

a disk;

a plurality of blades, each of said plurality of blades being mounted in said disk at a root portion, each of said plurality of blades having a tip portion, said tip portion defining an outer surface, a bridge member being attached to the outer surface and extending substantially an entire length of said outer surface and an opening having a preestablished cross-sectional configuration being defined between the outer surface and the bridge member; and a strap being movably positioned in said opening of corresponding ones of the plurality of blades and said strap having a preestablished cross-sectional configuration being substantually of the configuration of the preestablished cross-sectional configuration of the opening.

2. The turbine wheel assembly of claim 1 wherein said preestablished cross-sectional configuration of said opening and said strap have a generally rectangular configuration.

3. The turbine wheel assembly of claim 1 wherein said generally rectangular configuration of the opening defines a preestablished width "W" and a preestablished height "H".

4. The turbine wheel assembly of claim 3 wherein said generally rectangular configuration of the strap defines a preestablished thickness "T" and a preestablished width "WS".

5. The turbine wheel assembly of claim 4 wherein said preestablished width "W" is smaller to the preestablished width "WS".

6. The turbine wheel assembly of claim 1 wherein said opening defines an outer surface and said strap defines an outer circumferential surface and that during operation of the turbine wheel assembly said outer surface of the opening is in contacting relationship with the outer circumferential surface.

7. The turbine wheel assembly of claim 1 wherein said strap has a pair of ends.

8. The turbine wheel assembly of claim 7 wherein a pair of straps are positioned in the opening.

9. The turbine wheel assembly of claim 8 wherein said pair of ends on each of said pair of straps are assembled in an offset position.

10. The turbine wheel assembly of claim 1 wherein a pair of openings having a preestablished cross-sectional configuration are defined between the outer surface and the bridge member.

11. A turbine wheel assembly comprising:

a disk;

a plurality of blades, each of said plurality of blades being mounted in said disk at a root portion, each of said plurality of blades having a tip portion, said tip portion defining an outer surface, a bridge member being attached to the outer surface and an opening having a preestablished cross-sectional configuration being defined between the outer surface and the bridge member; and a pair of straps being positioned in said opening of corresponding ones of the plurality of blades, each of said pair of straps having a pair of ends and said pair of ends on each of said pair of straps being assembled in an offset position.

12. The turbine wheel assembly of claim 11 wherein said opening has a preestablished cross-sectional configuration.

13. The turbine wheel assembly of claim 12 wherein said strap has a preestablished cross-sectional configuration generally corresponding to the preestablished cross-sectional configuration of the opening.

14. The turbine wheel assembly of claim 13 wherein said preestablished cross-sectional configuration of the strap and the preestablished cross-sectional configuration of the opening defines a generally rectangular configuration.

15. The turbine wheel assembly of claim 14 wherein said generally rectangular configuration of the opening defines a preestablished width "W" and a preestablished height "H".

16. The turbine wheel assembly of claim 15 wherein said generally rectangular configuration of the strap defines a preestablished thickness "T" and a preestablished width "WS".

17. The turbine wheel assembly of claim 16 wherein said preestablished width "W" is generally equal to the preestablished width "WS".

18. The turbine wheel assembly of claim 11 wherein said strap is movable within the opening.

19. The turbine wheel assembly of claim 11 wherein said opening defines an outer surface and said strap defines an outer circumferential surface and that during operation of the turbine wheel assembly said outer surface of the opening is in contacting relationship with the outer circumferential surface.

* * * * *